United States Patent [19]

Hermes et al.

[11] Patent Number: 4,777,405

[45] Date of Patent: Oct. 11, 1988

[54] LOW-PRESSURE LAMP HAVING A PLURALITY OF TUBES AND A CYLINDRICAL TUBE SUPPORT

[75] Inventors: Guillaume M. P. G. Hermes; Patrick C. Van De Voorde, both of Terneuzen, Netherlands

[73] Assignee: U.S. Philips Corp., New York, N.Y.

[21] Appl. No.: 10,371

[22] Filed: Feb. 3, 1987

[30] Foreign Application Priority Data

Feb. 3, 1986 [NL] Netherlands ..... 8600252

[51] Int. Cl.[4] ..... H01J 61/30; H01J 9/26

[52] U.S. Cl. ..... 313/634; 313/493; 445/26

[58] Field of Search ..... 313/634, 493, 573, 25, 313/312, 317; 445/23, 26

[56] References Cited

U.S. PATENT DOCUMENTS 4,527,088 7/1985 Bouchard et al. ..... 313/634 X

*Primary Examiner*—David K. Moore
*Assistant Examiner*—K. Wieder
*Attorney, Agent, or Firm*—Brian J. Wieghaus

[57] ABSTRACT

Low-pressure mercury vapor discharge lamp having a discharge vessel sealed in a gas-tight manner and filled with mercury and a rare gas. The discharge vessel comprises four parallel extending straight tubular portions positioned in a square which are connected together by means of coupling joints to form a discharge passage. Two electrodes arranged at the ends of two tubular portions (4, 6) and are positioned side-by-side on one end of the discharge vessel. A discharge arc is maintained between the two electrodes through the discharge passage during lamp operation. A supporting member the four outer walls of the tube parts located between the four table parts engages the four outer walls of the tube parts near the ends of the tube parts remote from the electrodes.

14 Claims, 2 Drawing Sheets

LOW-PRESSURE LAMP HAVING A PLURALITY OF TUBES AND A CYLINDRICAL TUBE SUPPORT

BACKGROUND OF THE INVENTION

The invention relates to a low-pressure mercury vapour discharge lamp comprising a discharge vessel sealed in a gastight manner and filled with mercury and a rare gas. The discharge vessel comprises four parallel extending straight tubular portions positioned in a square. The tubular portions are connected together in a series arrangement to form a discharge passage. Two electrodes are arranged at the ends of two tube parts and are positioned side-by-side on one end of the discharge vessel. A discharge arc is maintained between the two electrodes during operation of the lamp. A lamp of this type is known from U.S. Pat. No. 4,374,340.

Lamps of this type are very compact and if they are provided with an electric stabilisation ballast, a starter and a lamp cap, they are suitable for fitting into holders which are intended for incandescent lamps. The known lamp therefore serves as an alternative to incandescent lamps for general illumination purposes.

Notably lamps provided with an electronic stabilisation ballast and a starter having a relatively small weight (as described, for example, in Netherlands Patent Application No. 8400923 laid open to public inspection) have been found to be very suitable for use in the lamp.

However, it has been found that when the lamp is screwed into the holder, comparatively great forces can be exerted by a user on the tube parts of the discharge vessel. The tube parts are connected together by means of coupling joints located near their ends (as described in the said U.S. Pat. No. 4,374,340) or the tube parts are connected together by means of U-shaped parts (see, for example, DE-OS No. 3,112,878) to which U.S. Pat. No. 4,481,442 corresponds. The coupling joints or U-shaped tube parts are vulnerable and therefore there is a real risk of breakage upon screwing the lamp into a holder.

SUMMARY OF THE INVENTION

It is an object of the invention to provide a lamp of the type described in the opening paragraph which can easily be screwed into an incandescent lamp holder and in which the risk of breakage of the glass discharge vessel is as small as possible.

To this end a lamp of this type according to the invention is characterized in that a supporting member engaging the outer walls of the four tube parts is present in a position located between the four tube parts and near the ends of the tube parts remote from the electrodes.

Due to the presence of the supporting member, which is secured to the tube parts by means of, for example, a suitable adhesive or clamping joint, the forces exerted by a user on the tube parts when the lamp is screwed into a holder are absorbed. The risk of breakage of the glass discharge vessel is therefore small.

The said supporting member preferably consists of a synthetic material such as polycarbonate. The member can then be manufactured more easily in large quantities.

The member may have several shapes. In one embodiment the member comprises a plate-shaped part which is positioned substantially transversely to the longitudinal axes of the tube parts. The tube parts are partly surrounded by the plate-shaped part and clamped therein.

In a practical embodiment of the lamp according to the invention the supporting member is cylindrical and is secured to the outer walls of the four tube parts. Centering lugs secured to the supporting member extend between each adjacent pair of tube parts.

The cylindrical supporting member is secured to the tube parts by means of an adhesive. Due to the presence of the lugs the comparatively small supporting member can be provided in a simple manner between the tube parts during manufacture of the lamps.

The invention will be described in greater detail with reference to the accompanying drawing.

BRIEF DESCRIPTION OF THE PREFERRED EMBODIMENTS

Figure 1:
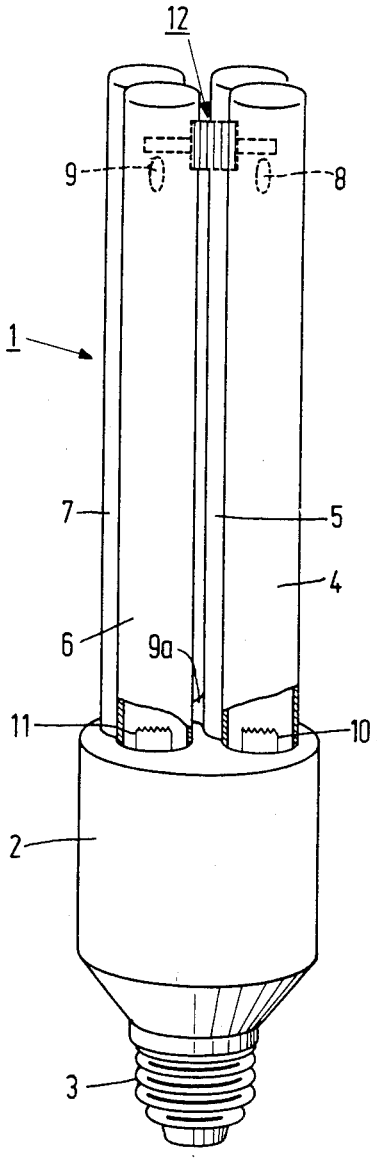
FIG. 1 is an elevational view of an embodiment of a low-pressure mercury vapour discharge lamp according to the invention.

The lamp of FIG. 1 comprises a glass discharge vessel 1 which is sealed in a gastight manner. A thin-walled synthetic material housing 2 is connected to lamp cap 3 with which the lamp can be screwed into a holder for incandescent lamps. The discharge vessel is supported in the housing and consists of four tube parts 4, 5, 6 and 7 positioned in a square which are connected together in a series arrangement so that the discharge passes through them during operation of the lamp. The said connections between the tube parts consist of coupling joints such as 8, 9 and **9*a* which are formed in a manner as described in U.S. Pat. No. 4,324,447. The coupling joint 9*a* between tube parts 5 and 7 is located near housing 2. During operation of the lamp the discharge is maintained between the electrodes 10 and 11 which are arranged at the ends of tube parts 4 and 6, respectively. Thus the electrodes 10 and 11** are present side by side on one end (the lower end) of the discharge vessel.

The current-supply wires for the electrodes are connected to an electric circuit present in the housing 2. This circuit serves to start and stabilise the discharge and is, for example, of a type as described in Netherlands Patent Application No. 8400923 to which U.S. Pat. No. 4,647,820 corresponds.

Figure 2:
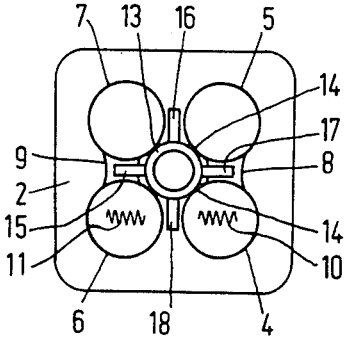
FIG. 2 is a plan view of the lamp of FIG. 1.

A synthetic material supporting member 12 is present in a position between the four tube parts and near their ends remote from the electrodes, which member consists of a cylindrical core 13 (see FIG. 2) which is secured to the tube parts by means of an adhesive, (for example, at 14), as well as four centring lugs 15 to 18 which are secured to the cylindrical core 13. These lugs are important during the manufacturing process of the lamp, when the supporting member is positioned between the tube parts. The member is formed in such a manner that two lugs (17 and 15) bear on the coupling joints 8 and 9.

Figure 3:
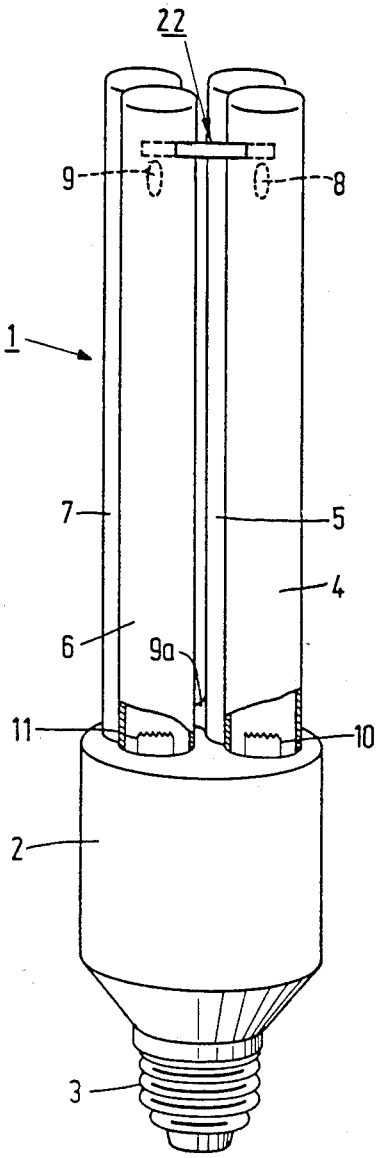
FIG. 3 is an elevational view of the discharge lamp having a plate-shaped support according to the invention.
Figure 4:
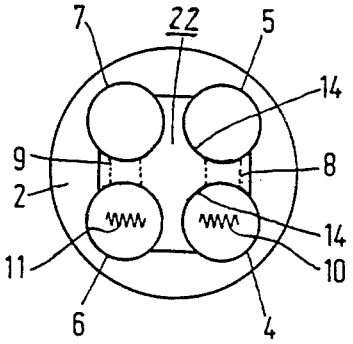
FIG. 4 is a plan view of the lamp in FIG. 3.

The lamp in FIG. 3 has a plate-shaped support 22 comprised of synthetic material. The support is present between the four tube parts near their ends remote from the electrodes and is positioned substantially transversely to the longitudinal axis of the tube parts. The plate-shaped part partly surrounds the tube parts with a clamping fit. The support 22 may be secured to the tube parts by means of an adhesive, for example at 14.

In a practical embodiment of the lamp described above the inner wall of the discharge vessel is provided with a luminescent layer consisting of a mixture of two phosphors, namely green luminescing cerium magnesium aluminate activated by terbium and red luminescing yttrium oxide activated by trivalent europium. The discharge vessel (consisting of four tube parts having a length of approximately 13 cm, internal diameter approximately 10 mm) contains a small quantity of mercury as well as argon under a pressure of 3 Torr (approximately 400 Pa). The length of the total lamp, i.e. the discharge vessel, the synthetic material housing (in which an electric circuit is present in accordance with Netherlands Patent application No. 8400923) and the edison cap is 21 cm in this embodiment. At a power supply of 20 W to the lamp the luminous flux is 1200 lm during operation.

What is claimed is:

1. A low pressure discharge lamp, comprising:

(a) a lamp base;

(b) a discharge vessel supported in said lamp base comprising a plurality of parallel tubular portions having adjacent first ends arranged around a common axis, means for connecting said tubular portions in series to form a continuous discharge path, first and second discharge electrodes arranged near two of said first ends, a discharge arc being maintained through said discharge path between said electrodes during lamp operation;

(c) a tube support comprising a cylinder arranged between said tubular portions remote from said first ends; and (d) means for adhering said support to each tubular portion.

2. A lamp as claimed in claim 1, wherein said cylinder comprises a protuberance extending between a pair of said tubular portions.

3. A lamp as claimed in claim 2, wherein said protuberance comprises a lug extending transverse to said cylinder and said tubular portions.

4. A lamp as claimed in claim 1, wherein said tubular portions are equidistant from said common axis and said cylinder comprises a plurality of protuberances each extending between a respective pair of said tubular portions.

5. A lamp as claimed in claim 1, wherein said connecting means comprises a coupling joint remote from said first ends connecting a pair of said tubular portions, and said support comprises a lug bearing against said coupling joint.

6. A lamp as claimed in claim 5, wherein said discharge device has only four (4) parallel tubular portions which are arranged in a square, a said coupling joint exceeds between each of two pairs of said tubular portions, and said support has a lug bearing against each said coupling joint.

7. A device as claimed in claim 6, wherein said connecting means comprises an adhesive.

8. A device as claimed in claim 1, wherein said connecting means comprises an adhesive.

9. A device as claimed in claim 4, wherein said connecting means comprises an adhesive.

10. A device as claimed in claim 5, wherein said connecting means comprises an adhesive.

11. A device as claimed in claim 1, wherein said tube support comprises a synthetic material.

12. A device as claimed in claim 11, wherein said synthetic material is a polycarbonate.

13. A low pressure discharge lamp, comprising:

(a) a lamp base;

(b) a discharge vessel supported in said lamp base comprising a plurality of parallel tubular portions having adjacent first ends arranged around a common axis, means for connecting said tubular portions in series to form a continuous discharge path, first and second discharge electrodes arranged near two of said first ends, a discharge arc being maintained through said discharge path between said electrodes during lamp operation;

(c) a tube support comprising a planar portion arranged between said tubular portions remote from said first ends and transverse to said tubular portions; and (d) means comprising an adhesive for securing said support to said tubular portion.

14. A lamp as claimed in claim 13, wherein said connecting means comprises a coupling joint remote from said first ends connecting a pair of said tubular portions and said planar portion comprises a protuberance extending between said pair of tubular portions bearing against said coupling joint.

* * * * *